US009932534B2

(12) United States Patent
Horst

(10) Patent No.: US 9,932,534 B2
(45) Date of Patent: Apr. 3, 2018

(54) HOMOGENEOUS SOLUTION OF A TREATED FUEL AND OXYGEN FROM THE AIR FOR USE IN A COMBUSTION CHAMBER

(71) Applicant: THE FUEL MATRIX, LLC, Henderson, NV (US)

(72) Inventor: Thomas R. Horst, Henderson, NV (US)

( * ) Notice: Subject to any disclaimer, the term of this patent is extended or adjusted under 35 U.S.C. 154(b) by 0 days.

(21) Appl. No.: 15/231,002

(22) Filed: Aug. 8, 2016

(65) Prior Publication Data

US 2018/0037833 A1 Feb. 8, 2018

(51) Int. Cl.

| | |
|---|---|
| ***C10L 10/00*** | (2006.01) |
| ***C10L 1/182*** | (2006.01) |
| ***C10L 1/12*** | (2006.01) |

(52) U.S. Cl.

CPC ..... *C10L 1/1824* (2013.01); *C10L 1/125* (2013.01); *C10L 10/00* (2013.01); *C10L 2270/026* (2013.01); *C10L 2270/04* (2013.01); *C10L 2290/24* (2013.01); *C10L 2290/36* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,386,938 | A | 6/1983 | Earle | |
| 4,599,088 | A | 7/1986 | Davis | |
| 4,668,245 | A | 5/1987 | Schieler | |
| 5,628,805 | A | 5/1997 | Lif | |
| 5,723,138 | A | 3/1998 | Bae | |
| 5,871,625 | A * | 2/1999 | Leddy | B03C 1/00 106/316 |
| 6,193,987 | B1 | 2/2001 | Harbeck | |
| 6,482,243 | B2 | 11/2002 | Podlipskiy | |
| 7,172,635 | B2 | 2/2007 | Bongardt | |

* cited by examiner

*Primary Examiner* — Ellen McAvoy
*Assistant Examiner* — Chantel Graham
(74) *Attorney, Agent, or Firm* — Nydegger & Associates

(57) ABSTRACT

In accordance with the present invention, a fuel/oxygen solution is provided for use in the operation of any type of combustion chamber. Operationally, the fuel/oxygen solution is created by a solvent which includes a hydrocarbon based fuel that has been treated with an electromagnetically modified ethanol additive, and a solute that includes paramagnetic oxygen molecules. Chemically, the solvent additive has increased InterMolecular Forces (IMFs) and dispersion forces for hydrocarbon molecules in a treated fuel to make these respective forces effectively comparable with IMFs and dispersion forces of a solute of paramagnetic oxygen molecules. Thus, when atomized in a combustion chamber, the treated fuel acts as a more efficient solvent for dissolving oxygen from the air, to thereby create the fuel/oxygen solution for use in the combustion chamber.

16 Claims, 1 Drawing Sheet

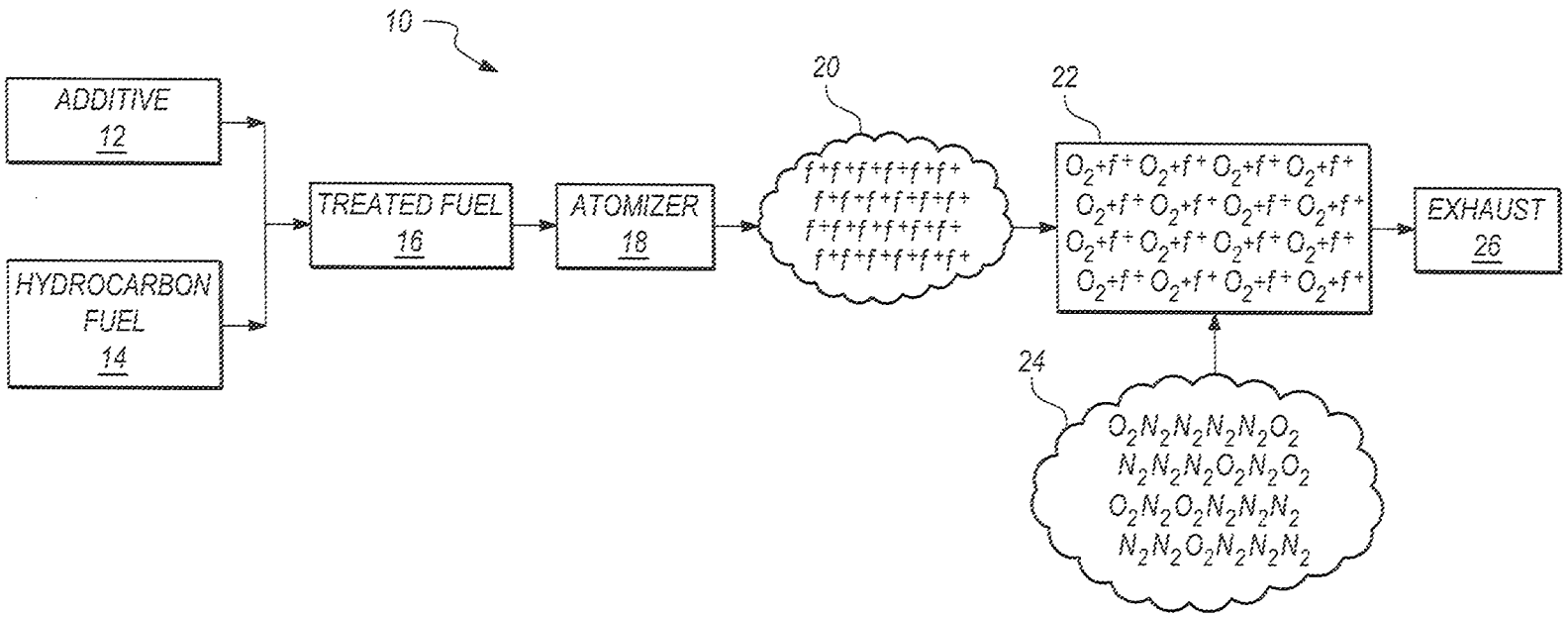
10
ADDITIVE
12
HYDROCARBON FUEL
14
TREATED FUEL
16
ATOMIZER
18
20
f+f+f+f+f+f+f+f+
f+f+f+f+f+f+f+f+
f+f+f+f+f+f+f+f+
f+f+f+f+f+f+f+f+
22
O2+f+O2+f+O2+f+O2+f+
O2+f+O2+f+O2+f+O2+f+
O2+f+O2+f+O2+f+O2+f+
O2+f+O2+f+O2+f+O2+f+
24
O2N2N2N2N2O2
N2N2N2O2N2O2
O2N2O2N2N2N2
N2N2O2N2N2N2
EXHAUST
26

HOMOGENEOUS SOLUTION OF A TREATED FUEL AND OXYGEN FROM THE AIR FOR USE IN A COMBUSTION CHAMBER

FIELD OF THE INVENTION

The present invention pertains generally to fuel/oxygen solutions which are created for use in a combustion chamber. More particularly, the present invention pertains to treatments for hydrocarbon based fuels that increase and extend the homogeneity of oxygen in the fuel, when the fuel has been treated, and oxygen is dissolved into solution with the treated fuel for fuel combustion. The present invention is particularly, but not exclusively, useful as a hydrocarbon based fuel, wherein the InterMolecular Forces (IMFs) of hydrocarbon molecules in the fuel have been increased by an additive containing electromagnetically modified ethanol, which thereby causes the treated fuel to more efficiently act as a solvent for dissolving oxygen solutes from the air for a more effective combustion of the treated fuel.

BACKGROUND OF THE INVENTION

In order to generate energy, hydrocarbon based fuels rely on an oxidation of the fuel that occurs during a combustion of the fuel. To do this, a typical combustion chamber creates a fuel-air mixture which constitutes an explosive charge. The fuel-air mixture is then ignited in a controlled manner to oxidize hydrocarbons in the fuel, and thereby generate energy. As a mixture, however, the fuel and air constituents of a fuel-air mixture are not (emphasis added) chemically combined in fixed proportions to each other. Stated differently, a mixture need not necessarily be homogeneous and, typically, it will not be homogeneous.

Unlike a mixture, which is typically not homogeneous, a chemical solution will necessarily be homogeneous. In particular, a liquid solution results when one substance, a solute, is dissolved in another substance, a solvent. By definition, when dissolved, the two substances (solvent-solute) form a homogeneous molecular structure. Thus, unlike when they are combined as a mixture, the substances within a solution are homogeneous and have fixed proportions relative to each other. The ability of a solvent to dissolve a solute, however, depends on the InterMolecular Forces (IMFs) that exist between the solute and the solvent.

An important aspect for the present invention is the fact that the IMFs of hydrocarbons in a fuel can be increased when treated with an additive, such as the fuel additive disclosed in U.S. patent application Ser. No. 15/230,894 for an invention entitled "Electromagnetically Modified Ethanol" which is assigned to the same assignee as the present invention, and which was filed concurrently with the present application and which is incorporated herein by reference.

Importantly, as envisioned for the present invention, the IMFs of hydrocarbons in a treated fuel can be increased to become effectively equal to the IMFs of paramagnetic oxygen molecules. Moreover, the dispersion forces of hydrocarbons in the treated fuel can also be effectively equalized with the dispersion forces of oxygen molecules. The consequence here is that a fuel/oxygen solution will be homogenized and better oxygenated than will a comparable volume of a commonly created fuel-air mixture.

In light of the above, it is an object of the present invention to increase oxygen homogeneity in a fuel/oxygen solution, for an improved oxygenation of a treated fuel during combustion of the treated fuel. Another object of the present invention is to provide a treated fuel which is a more active solvent for oxygen from the air than would otherwise be possible with an untreated fuel. Still another object of the present invention is to improve the combustion efficiency of a hydrocarbon based fuel by treating the fuel, and atomizing the treated fuel into solution with oxygen from the air, to achieve better oxygenation in the treated fuel and thereby generate more energy per fuel volume during combustion of the fuel/oxygen solution. Yet another object of the present invention is to provide a means and a methodology for employing a fuel/oxygen solution in a combustion chamber which is easy to use, is commercially viable, and is comparatively cost effective.

SUMMARY OF THE INVENTION

In accordance with the present invention, a fuel/oxygen solution for use in a combustion chamber includes an additive which has been electromagnetically radiated to create adducts for the additive. When dissolved in a hydrocarbon based fuel, the additive creates a treated fuel. Importantly, due to adducts in the additive, hydrocarbon molecules in the treated fuel will have InterMolecular Forces (IMFs) and dispersion forces (London forces) that are comparable to those of paramagnetic oxygen molecules. Consequently, when treated fuel is atomized in air, inside a combustion chamber of an engine, oxygen from the air will homogeneously dissolve into the treated fuel. The result is the fuel/oxygen solution of the present invention which will have a more complete oxygenation of the fuel and an improved energy generation during combustion of the fuel/oxygen solution.

The treated fuel, which is the basis of the present invention, differs from an untreated hydrocarbon based fuel in at least one important particular. Specifically, because adducts establish stronger dipoles in the additive, the adducts will influence polarization in the hydrocarbon molecules of a treated fuel. As a consequence, a treated hydrocarbon based fuel will exhibit stronger IMFs and dispersion forces, which enhance the dissolution of paramagnetic oxygen molecules into the treated fuel for combustion. As recognized by the present invention, the strong dipoles of the additive (i.e. adducts), result when a metallic ion solution is radiated with an electromagnetic wave.

In overview, the present invention results from a succession of three solution processes. The first solution process occurs when a mineral solution is dissolved into an ethanol-water solution to create a metallic ion solution. It is this metallic ion solution that is then radiated with an electromagnetic wave to create an additive including adducts. The second solution process involves dissolving the additive into a hydrocarbon based fuel to create the treated fuel that will have stronger IMFs and dispersion forces. The third solution process involves atomizing the treated fuel in a combustion chamber to create the fuel/oxygen solution of the present invention. In accordance with the present invention, a combustion chamber is envisioned for various purposes, to include: engines, furnaces and other type burners. As noted above, the result in the combustion chamber is a more completely oxygenated fuel with improved energy generation during combustion of the fuel/oxygen solution.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

The FIGURE is a schematic representation of the process required for creating a fuel/oxygen solution for the combustion of a hydrocarbon based fuel in a combustion chamber.

DESCRIPTION OF THE PREFERRED EMBODIMENTS

Referring to the FIGURE, a schematic representation of a process for creating and using a fuel/oxygen solution in accordance with the present invention is shown and is generally designated 10. As shown, the process 10 requires an additive 12 that is dissolved into solution with a hydrocarbon based fuel 14, to create a treated fuel 16.

For purposes of the present invention, the additive 12 is a solution that is created by first dissolving a mineral solution in an ethanol-water solution. The result of this dissolution is a metallic ion solution. The additive 12 then results when the metallic ion solution is radiated with an electromagnetic wave. In detail, this radiation creates adducts for the additive 12, wherein the adducts maintain the permanent charge of the ion that was present in the metallic ion solution. As shown in the FIGURE, the dissolution of additive 12 in a hydrocarbon based fuel 14 results in a treated fuel 16.

Further, the electromagnetic wave may be either unidirectionally or multi-directionally radiated into the metallic ion solution, and it may be generated continuously, or it may be pulsed.

For purposes of the present invention, the operational parameters of the electromagnetic wave will be as follows. The wavelength $\lambda$ of the electromagnetic wave will in a range between $10^{-7}$ m and $10^{-8}$ m. The energy E of the electromagnetic wave will be in a range between 150 kJ/mol and 300 kJ/mol. And, the metallic ion solution will be radiated for a time duration $\Delta t$ between one and two hours.

As envisioned for the present invention, the hydrocarbon fuel 14 can be any well-known type of fuel, such as an automotive, aviation, or diesel fuel. The important consideration here is that adducts in the additive 12 will combine with hydrocarbon molecules of fuel 14 to create stronger InterMolecular Forces (IMFs) and stronger dispersion forces in the hydrocarbon molecules of the treated fuel 16. More specifically, these IMFs and dispersion forces in the treated fuel 16 need to be essentially comparable to the IMFs and dispersion forces of paramagnetic oxygen molecules.

The FIGURE indicates that an atomizer 18 is to be used to vaporize the treated fuel 16 into a mist 20 that includes droplets $f^+$ of the treated fuel 16. For purposes of the present invention, the atomizer 18 can be any type of fuel injector that is appropriate for the type of hydrocarbon fuel 14 being used. As indicated in the FIGURE, the mist 20 of droplets $f^+$ of treated fuel 16 is to be injected into a combustion chamber 22 by the atomizer 18.

In the combustion chamber 22, droplets $f^+$ from the mist 20 go into dissolution with oxygen molecules $O_2$ from air 24 to create droplets of a fuel/oxygen solution $O_2+F^+$. Recall, as stated above, the IMFs and dispersion forces of the paramagnetic oxygen molecules $O_2$ and the droplets $f^+$ of treated fuel 16 are comparable. As also stated above, this relationship makes the droplets $f^+$ of treated fuel 16 a perfect solvent for the oxygen molecules $O_2$ from air 24. On the other hand, there is no comparable relationship between the droplets $f^+$ of treated fuel 16 and the nitrogen molecules $N^+$. A consequence here is that, although the combustion efficiency of the treated fuel 16 is substantially improved, there is no corresponding increase in pollutants in the exhaust 26.

While the particular Homogeneous Solution of a Treated Fuel and Oxygen from the Air for use in a Combustion Chamber as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A fuel/oxygen solution for use in a combustion chamber which comprises:

a first solvent including ethanol molecules having dipoles with a first polarity, wherein the first solvent is a solution of ethanol and water wherein the percentage of water in the ethanol-water solution is in a range between 2% and 7%;

a first solute including metallic ions having a permanent charge, wherein the first solute is dissolved in the first solvent to formulate a metallic ion solution, and wherein the metallic ion solution is radiated with an electromagnetic wave to create adducts therein for an additive, wherein the adducts in the additive have dipoles with a second polarity and wherein the second polarity of dipoles in the additive is greater than the first polarity of dipoles in the first solvent;

a hydrocarbon based fuel, wherein the additive is dissolved into the hydrocarbon based fuel to create a treated fuel; and air, including paramagnetic oxygen molecules, wherein the paramagnetic oxygen molecules are dissolved as a second solute in the treated fuel to form the fuel/oxygen solution when the treated fuel is atomized in air inside the combustion chamber.

2. The fuel/oxygen solution recited in claim 1 wherein the first solute includes the metallic ions of a mineral selected from the group consisting of potassium, aluminum, boron and iron.

3. The fuel/oxygen solution recited in claim 1 wherein each adduct is an unbonded inclusion complex containing charged particles of a metallic ion and molecules in a shell of ethanol and water.

4. The fuel/oxygen solution recited in claim 1 wherein the electromagnetic wave has operational parameters including a predetermined wavelength $\lambda$, a predetermined energy E, and a predetermined time duration $\Delta t$.

5. The fuel/oxygen solution recited in claim 4 wherein the predetermined wavelength $\lambda$ is in a range between $10^{-7}$ m and $10^{-8}$ m wherein the predetermined energy E is in a range between 150 kJ/mol and 300 kJ/mol.

6. The fuel/oxygen solution recited in claim 4 wherein the metallic ion solution is radiated for a time duration $\Delta t$ between one and two hours.

7. The fuel/oxygen solution recited in claim 1 wherein the treated fuel is homogeneous and has a constituent concentration in a range of 1 to 5 parts additive per more than 20,000 parts hydrocarbon fuel.

8. The fuel/oxygen solution recited in claim 1 selected from the group consisting of hydrocarbon fuel, jet fuel, aviation fuel and diesel fuel.

9. A fuel/oxygen solution for use in a combustion chamber which comprises:

a first solvent including ethanol molecules having dipoles with a first polarity;

a first solute including metallic ions having a permanent charge, wherein the first solute is dissolved in the first solvent to formulate a metallic ion solution, and wherein the metallic ion solution is radiated with an electromagnetic wave to create adducts therein for an additive, wherein the electromagnetic wave has operational parameters including a predetermined wavelength $\lambda$, a predetermined energy E, and a predetermined time duration $\Delta t$, wherein the adducts in the additive have dipoles with a second polarity and wherein the second polarity of dipoles in the additive is greater than the first polarity of dipoles in the first solvent;

a hydrocarbon based fuel, wherein the additive is dissolved into the hydrocarbon based fuel to create a treated fuel; and air, including paramagnetic oxygen molecules, wherein the paramagnetic oxygen molecules are dissolved as a second solute in the treated fuel to form the fuel/oxygen solution when the treated fuel is atomized in air inside the combustion chamber.

10. The fuel/oxygen solution recited in claim 9 wherein the predetermined wavelength $\lambda$ is in a range between $10^{-7}$ m and $10^{-8}$ m wherein the predetermined energy E is in a range between 150 kJ/mol and 300 kJ/mol.

11. The fuel/oxygen solution recited in claim 9 wherein the first solvent is a solution of ethanol and water wherein the percentage of water in the ethanol-water solution is in a range between 2% and 7%.

12. The fuel/oxygen solution recited in claim 9 wherein the first solute includes the metallic ions of a mineral selected from the group consisting of potassium, aluminum, boron and iron.

13. The fuel/oxygen solution recited in claim 9 wherein each adduct is an unbonded inclusion complex containing charged particles of a metallic ion and molecules in a shell of ethanol and water.

14. The fuel/oxygen solution recited in claim 9 wherein the metallic ion solution is radiated for a time duration $\Delta t$ between one and two hours.

15. The fuel/oxygen solution recited in claim 9 wherein the treated fuel is homogeneous and has a constituent concentration in a range of 1 to 5 parts additive per more than 20,000 parts hydrocarbon fuel.

16. The fuel/oxygen solution recited in claim 9 selected from the group consisting of hydrocarbon fuel, jet fuel, aviation fuel and diesel fuel.

* * * * *